US008979595B2

(12) United States Patent
Yen et al.

(10) Patent No.: US 8,979,595 B2
(45) Date of Patent: Mar. 17, 2015

(54) ELECTRICAL CONNECTOR AND METHOD OF MANUFACTURE

(71) Applicant: Chant Sincere Co., Ltd., New Taipei (TW)

(72) Inventors: Ming Hui Yen, New Taipei (TW); Chih Hsuan Chia, New Taipei (TW)

(73) Assignee: Chant Sincere Co., Ltd., New Taipei (TW)

( * ) Notice: Subject to any disclaimer, the term of this patent is extended or adjusted under 35 U.S.C. 154(b) by 114 days.

(21) Appl. No.: 13/921,347

(22) Filed: Jun. 19, 2013

(65) Prior Publication Data

US 2014/0154923 A1 Jun. 5, 2014

(30) Foreign Application Priority Data

Nov. 30, 2012 (TW) ..... 101144872 A

(51) Int. Cl.

| | |
|---|---|
| ***H01R 24/00*** | (2011.01) |
| ***H01R 13/516*** | (2006.01) |
| ***H01R 43/18*** | (2006.01) |
| ***H01R 43/16*** | (2006.01) |
| *H01R 24/62* | (2011.01) |

(52) U.S. Cl.

CPC ..... *H01R 13/516* (2013.01); *H01R 43/18* (2013.01); *H01R 43/16* (2013.01); *H01R 24/62* (2013.01)

USPC ..... 439/660; 29/876

(58) Field of Classification Search

USPC ..... 439/660, 79, 606, 736

See application file for complete search history.

(56) References Cited

U.S. PATENT DOCUMENTS

| | | | | |
|---|---|---|---|---|
| 8,083,546 | B2 * | 12/2011 | Lee | 439/607.02 |
| 8,172,585 | B2 * | 5/2012 | Chiu et al. | 439/108 |
| 8,187,039 | B2 * | 5/2012 | Tsai | 439/660 |
| 8,398,416 | B2 * | 3/2013 | Tseng | 439/188 |
| 8,523,610 | B2 * | 9/2013 | Kuster | 439/607.01 |
| 8,790,138 | B2 * | 7/2014 | Wang et al. | 439/660 |

* cited by examiner

*Primary Examiner* — Xoung Chung Trans

(74) *Attorney, Agent, or Firm* — Bacon & Thomas, PLLC

(57) ABSTRACT

An electrical connector, including a shell, a housing and a plurality of metal terminals, configures a chamber that several ribs allocate the chamber with terminal recesses, a ramped portion being formed at the bottom of chamber, the terminals pass through terminal recesses in which the terminals are assembled amid housing, among the sections of the terminals, a contact section forming a engagement in front of the ramped portion of chamber.

10 Claims, 11 Drawing Sheets

ELECTRICAL CONNECTOR AND METHOD OF MANUFACTURE

BACKGROUND OF THE INVENTION

1. Field of the Invention

The present invention relates generally to an electrical connector, and more specifically, to an electrical connector that improving the mating means thereof, wherein providing a solution to a long-term mating cycle nearly leads to fail the elasticity of contact arms; moreover, to avoid like cycle bringing dead pins or else problems.

2. Description of the Related Art

An electrical socket, early disclosed in Taiwan Patent No. M346928, is provided of which includes an insulative housing, an eSATA terminals installed on the top of the tongue of the insulative housing and an plurality of USB terminals installed on the bottom of said tongue. The eSATA terminals address the conformation with an eSATA standard; the plurality of USB terminals address the conformation basically with an USB2.0 standard and further with an USB3.0 standard which is able to perform higher speeds of transmission. Therefore, the electrical socket adapts to be used in miscellaneous type of connector.

The conventional USB3.0 standard is known as transmitting mass data in 5 Gbps bitrates, which keeps its pace to do that by first defining five more pins. These five pins, that ever been stated the principle to make a plug in detail, generally configure as elastic articles, related to non-elastic as the original four pin. The elastic pins are predetermined to contact with the opposite pin of a socket when the plug connector is inserted into such socket by the user. For sake of the resilient feature, an up-side-down exercise is been predictable. However, the duration cycle of withdrawal connector is such concerned by connector maker. Even the duration is up-evaluated; but the lasting of the elasticity was less concerned. Sometimes, the high-profile connection depends that these five pin just can survive after a long-term removing exercise.

The conventional connector and now-on product seems to concentrate saving cost of manufacturing the connector. The tiredness of these five elastic pins which brings damages to the stability of connector is still a serious problem of people's lack aware.

SUMMARY OF THE INVENTION

For solving the poor situation occurred in the conventional art, therefore, it is necessary to modify and to find an improved means for mating electrical connector, thereto providing a solution to insert different type plugs into identical connector without bringing destructions itself.

The present invention is ultimately to provide an electrical connector, comprising: an insulative housing, a plurality of first terminals, a plurality of second terminals and a shell.

The insulative housing is engaging with the shell and further includes a tongue extended along a back-to-front direction and a base portion located behind the tongue. The insulative housing configures a hollow chamber in the center of its body, hereunder the area between the tongue and the base portion, the chamber is equally divided into several independent slots by a plurality of ribs, which configures ramping portions in the bottom of slots that ascends the ramping portion to the base portion.

A plurality of first terminals is configured on the insulative housing and passes through the slots, wherein each first terminal has an elastic curve-shape contact end, a rear portion and a body portion connecting two. The rear portion is held by the base portion of the insulative housing; the contact end and the body portion are exposed out of the base portion, and locate in the slot. In the section between the contact end and the body portion, a neck, a taper and an engagement are configured in sequence, a preserved space is formed by the leant neck and engagement and under the taper, the engagement extends further into the bottom of slots and remains contacting with the ramping portions.

A plurality of second terminals is configured on the insulative housing and crosses with the plurality of first terminals in a transverse direction. Both of the terminals are toward the same direction with an up and down arrangement. A body portion is held by the base portion and ribs of the insulative housing. One end of second terminal extends out of the base portion; the other end passes through the rib and extends to be disposed above of the tongue.

The taper of the contact end is generally in a curve-shape; said neck is configured from said body portion and extends upwardly to said taper. The preserved space is formed by the leant neck and said engagement and under said taper.

Said body portion is configuring with a flat and an extension. Said flat connects said neck in one end and connects to said extension in the other end. Said extension connects to said rear portion.

Said first terminals configure apertures on the two side terminal onto said engagement.

BRIEF DESCRIPTION OF THE DRAWINGS

FIG. 7.B is a closely view of the die used to manufacture the electrical connector shown in FIG. 7.A, specified the step (c) of method thereof.

FIG. 8.B is a closely view of the die used to manufacture the electrical connector shown in FIG. 8.A, specified the step (d) of method thereof.

DETAILED DESCRIPTION OF THE EMBODIMENT(S)

This invention is to show a main purpose that is to accomplish a non-cracking terminal mounting in the electrical connector, where it encounters a long-term mating cycle nearly leads to fail the elasticity of contact arms; moreover, to avoid like cycle bringing dead pins or else problems.

Figure 1:
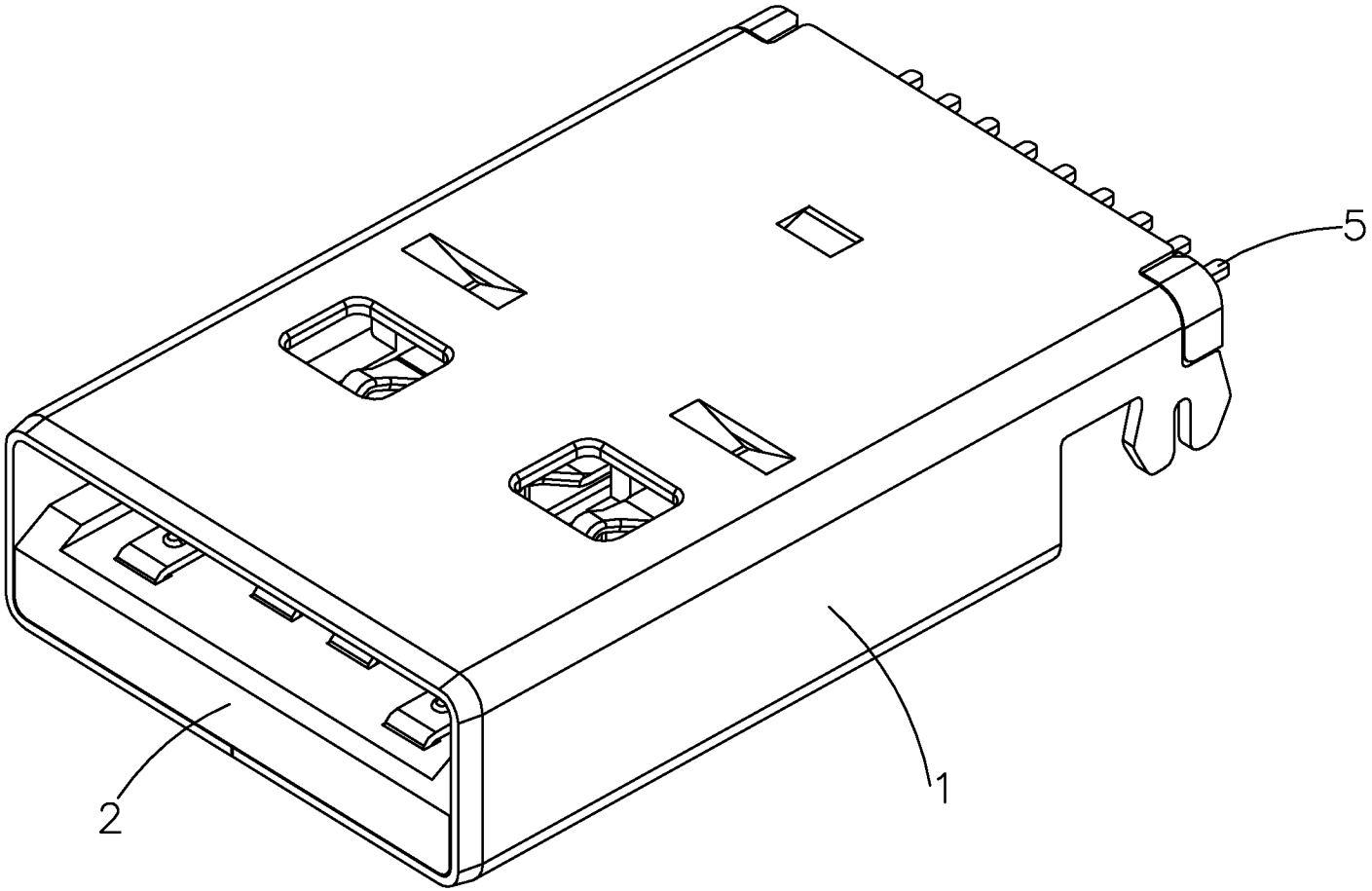
FIG. 1 is a perspective view of the electrical connector formed in accordance with an embodiment of the invention.
Figure 2:
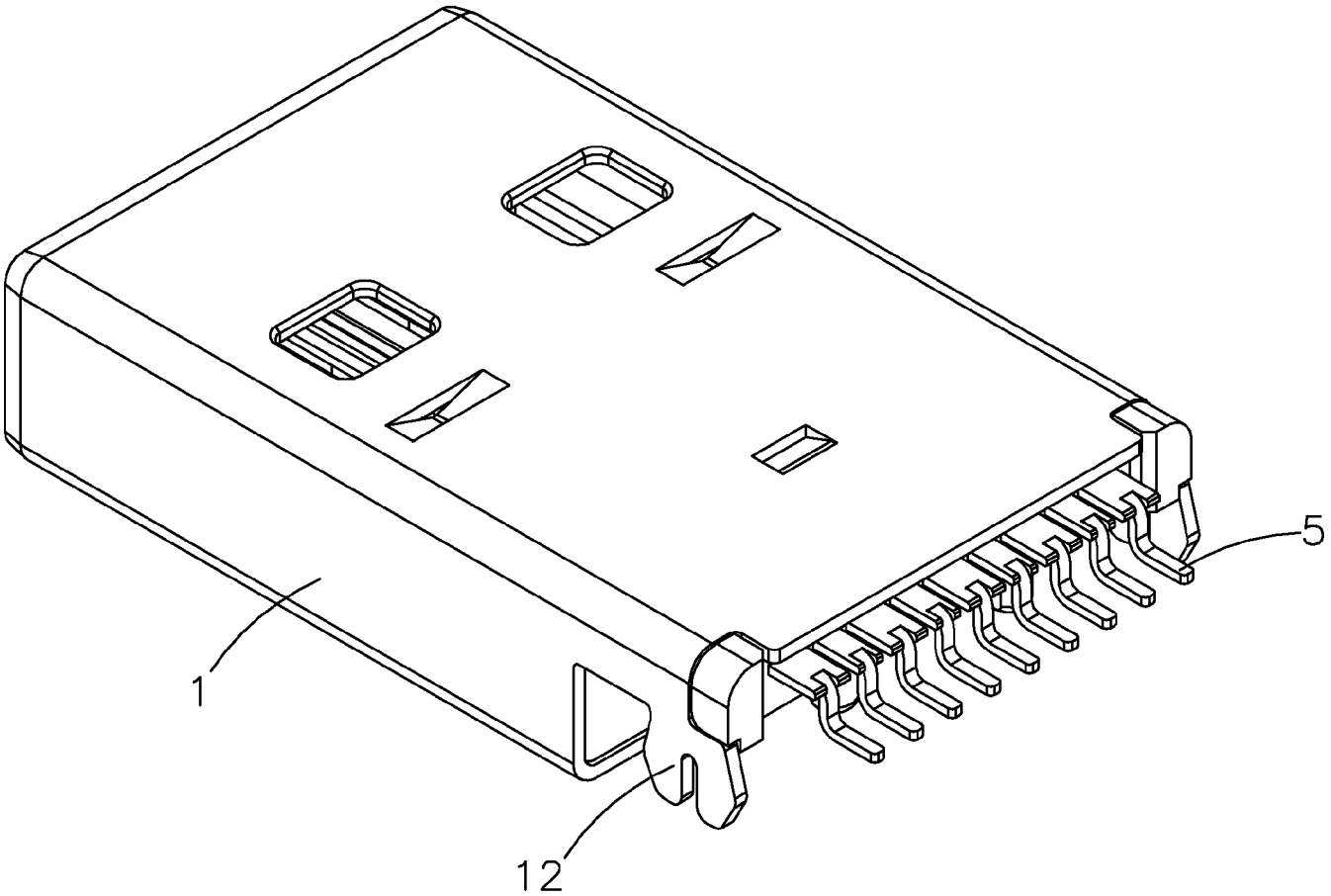
FIG. 2 is another perspective view shown in FIG. 1.
Figure 3:
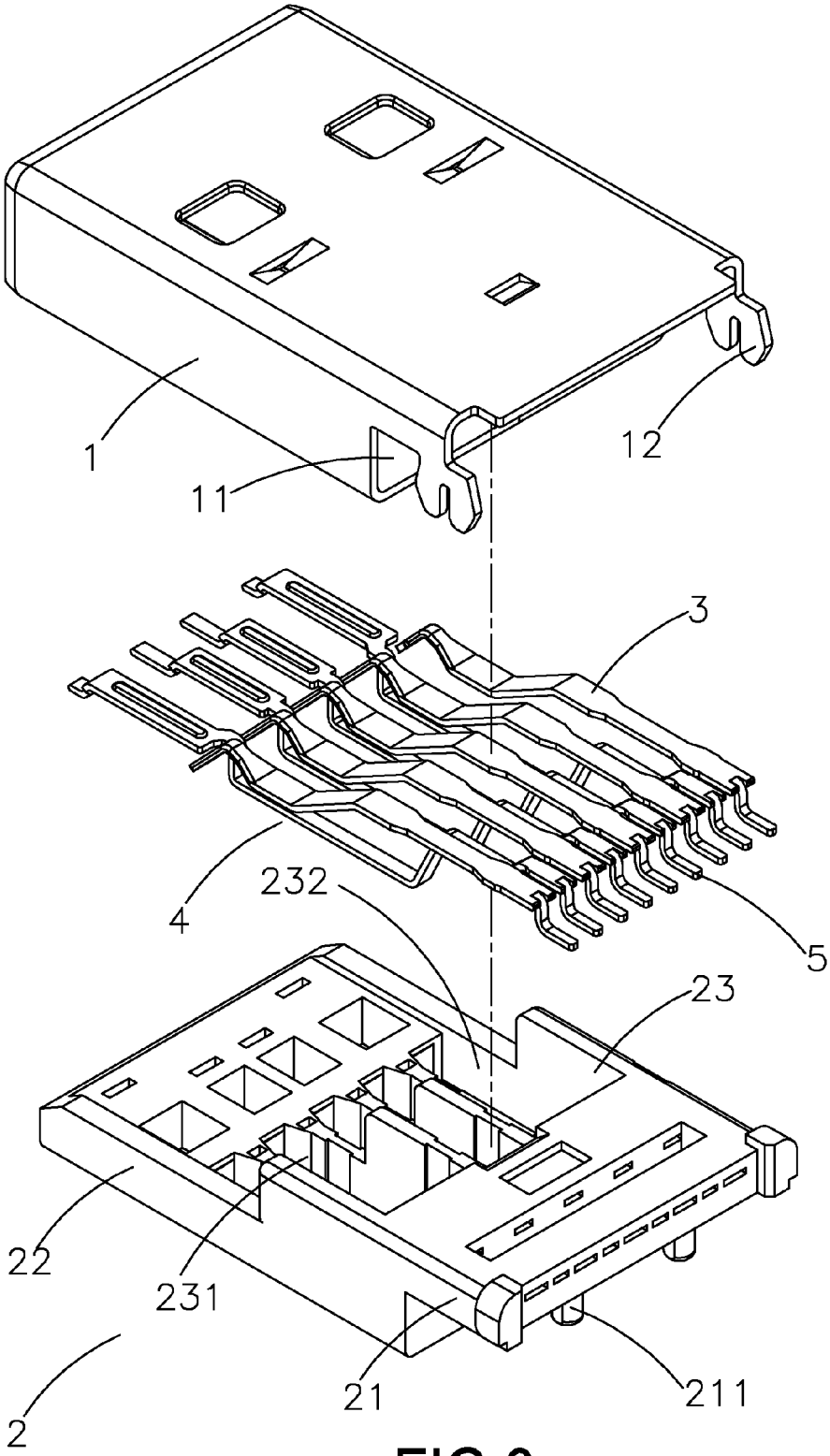
FIG. 3 is an exploded perspective view shown in FIG. 1.

As shown in FIGS. 1-3, an electrical connector comprises: an insulative housing 2, a plurality of first terminals 3, a plurality of second terminals 4 and a shell 1.

The insulative housing 2 is engaging with the shell land further includes a tongue 22 extended along a back-to-front (transverse) direction and a base portion 21 located behind the tongue 22. The insulative housing 2 configures a hollow chamber 23 in the center of its body, hereunder the area between the tongue 22 and the base portion 21. The chamber 23 is equally divided into several independent slots 232 by a plurality of ribs 231, which configures ramping portions 2321 in the bottom 234 of slots 232 that ascends the ramping portion 2321 to the base portion 21.

Figure 4:
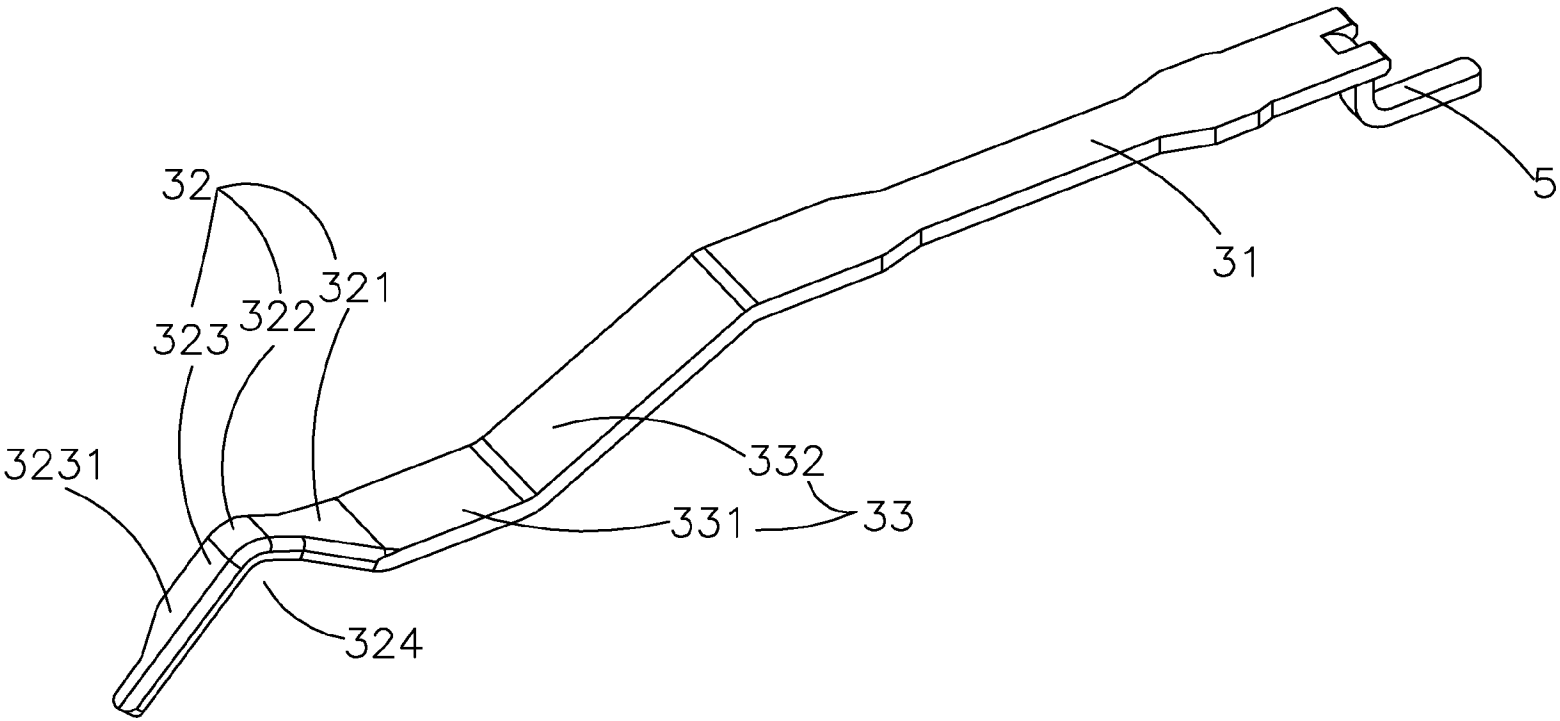
FIG. 4 is a perspective view of the first terminal of electrical connector formed in accordance with an embodiment of the invention.

As shown in FIG. 4, a plurality of first terminals 3 is configured on the insulative housing 2 and passes through the slots 232, wherein each first terminal 3 has an elastic curve-shape contact end 32, a rear portion 31 and a body portion 33 connecting two (the contact end and rear portion). The rear portion 31 is held by the base portion 21 of the insulative housing 2; the contact end 32 and the body portion 33 are exposed out of the base portion 21, and locate in the slot 232. Moreover, in the section between the contact end 32 and the body portion 33, a neck 321, a taper 322 and an engagement 323 are configured in sequence. A preserved space 324 is formed by the leant neck 321 and engagement 323 and under the taper 322. The engagement 323 extends further into the bottom 234 of slots 232 and remains contacting with the ramping portions 2321.

A plurality of second terminals 4 is configured on the insulative housing 2 and crosses with the plurality of first terminals 3 in a transverse direction. More precisely, both of the terminals 5 are toward the same direction with an up and down arrangement. A body portion 41 is held by the base portion 21 and ribs 231 of the insulative housing 2. One end of second terminal extends out of the base portion 21; the other end passes through the rib 231 and extends to be disposed above of the tongue 22.

Figure 5:
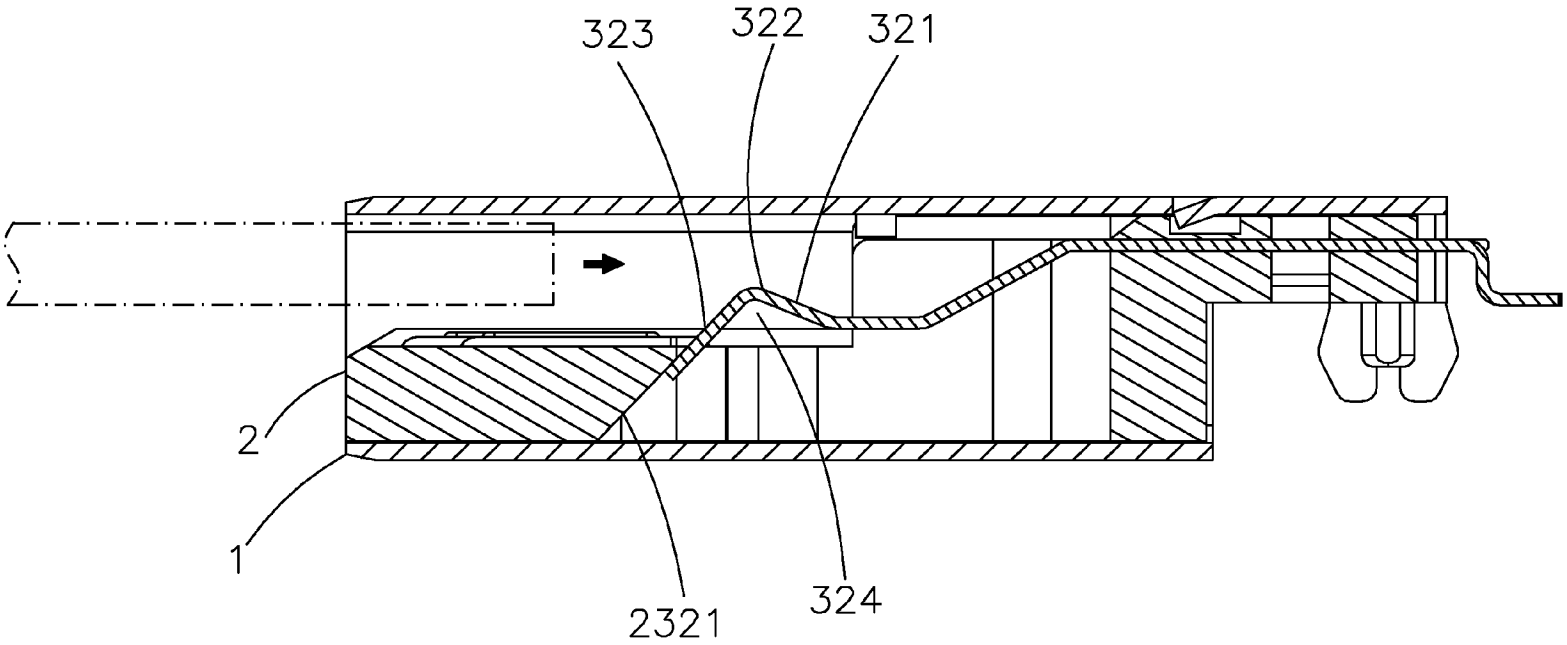
FIG. 5 is a cross-section view of the electrical connector shown in FIG. 1, illustrated the electrical connector standing by inserting an outer plug.
Figure 6:
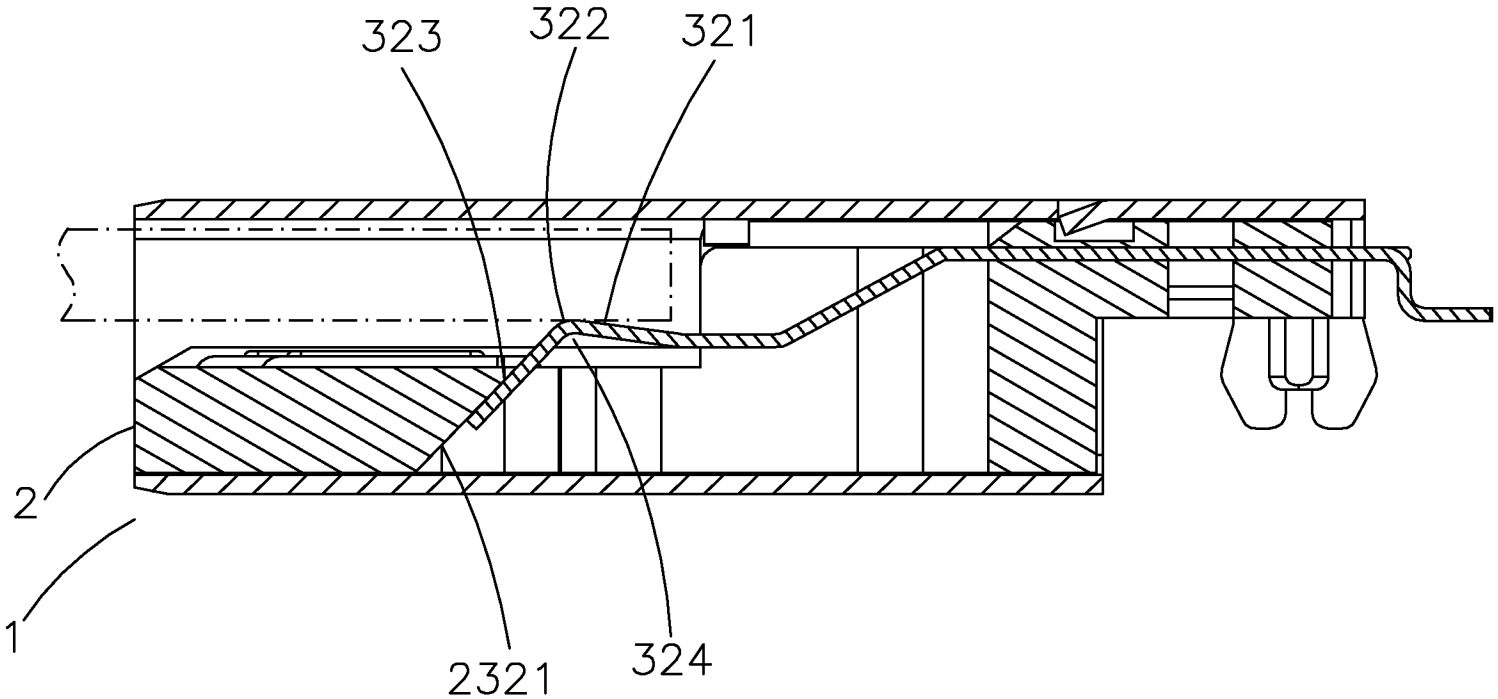
FIG. 6 is a cross-section view of the electrical connector shown in FIG. 5, illustrated the electrical connector inserting an outer plug.

Thus, see FIGS. 5-6, when the electrical connector is connected with a computer system by the user, (firstly we assume a socket connector mounted inside the computer system, having all elements of which a connector consists) the contact ends 32 of first terminals 3 are pressed, for the sake of its elasticity, to move slightly backward in the range permitted by the space 324. When the electrical connector is withdrawn from the computer system by the user, the contact ends 32 rebounds until the ramping portions 2321 of the insulative housing 2 stops the engagement 323 at the bottom 234 of slots 232, and remains contacting with the ramping portions 2321 as beginning. The ramping portions 2321 provide a guarantee of non-cracking terminal that destructions often occur as over-rebound of the terminal so that the terminal is able to keep its elasticity of contact end 32 eventually.

The taper 322 of the contact end 32 is generally in a curve-shape; the neck 321 is configured from the body portion 33 and extends upwardly to the taper 322. The preserved space 324 is formed by the leant neck 321 and engagement 323 and under the taper 322. By these two characteristics, the first terminal 3 is able to keep its elasticity of contact end 32 when the electrical connector is withdrawn from the computer system by the user.

The body portion 33 is selectively configuring with a flat 331 and an extension 332. The flat 331 connects the neck 321 in one end and connects to the extension 332 in the other end, wherein the angle of both connections is larger than 90 degree. And, the extension 332 connects to the rear portion 31. The flat 331 and the extension 332 provide an elastic structure between the contact end 32 and the body portion 33. The engagement 323 configures an aperture 3231 thereof.

As shown in FIGS. 5-6, when the electrical connector is connected with a computer system by the user, the contact ends 32 of first terminals 3 are pressed (by, we assume, an element of a socket connector, such as a tongue), wherein the contact ends 32 is descending little by little from the engagement 323 up to the taper 322. This movement remains until the external object is stopped by inside wall of the insulative housing 2; and at this point, the contact ends 32 descends almost below the level of the tongue 22.

When the electrical connector is withdrawn from the computer system by the user, the contact ends 32 rebounds until the ramping portions 2321 of the insulative housing 2 stops the engagement 323 at the bottom 234 of slots 232, and remains contacting with the ramping portions 2321 as beginning. The ramping portions 2321 provide a guarantee of non-cracking terminal that destructions often occur as over-rebound of the terminal so that the terminal is able to keep its elasticity of contact end 32 eventually.

The insulative housing 2 is engaging with the shell land further includes a tongue 22 extended along a back-to-front (transverse) direction and a base portion 21 located behind the tongue 22. The tongue 22 and the base portion 21 are suggested to establish as a step-on structure, where the tongue 22 is comparatively lower than the datum of the base portion 21. The insulative housing 2 configures a hollow chamber 23 in the center of its body, hereunder the area between the tongue 22 and the base portion 21. The chamber 23 is equally divided into several independent slots 232 by a plurality of ribs 231, which configures ramping portions 2321 in the bottom 234 of slots 232 that ascends the ramping portion 2321 to the base portion 21. The plurality of ribs 231 provides the isolation of those conductive parts.

Figure 7A:
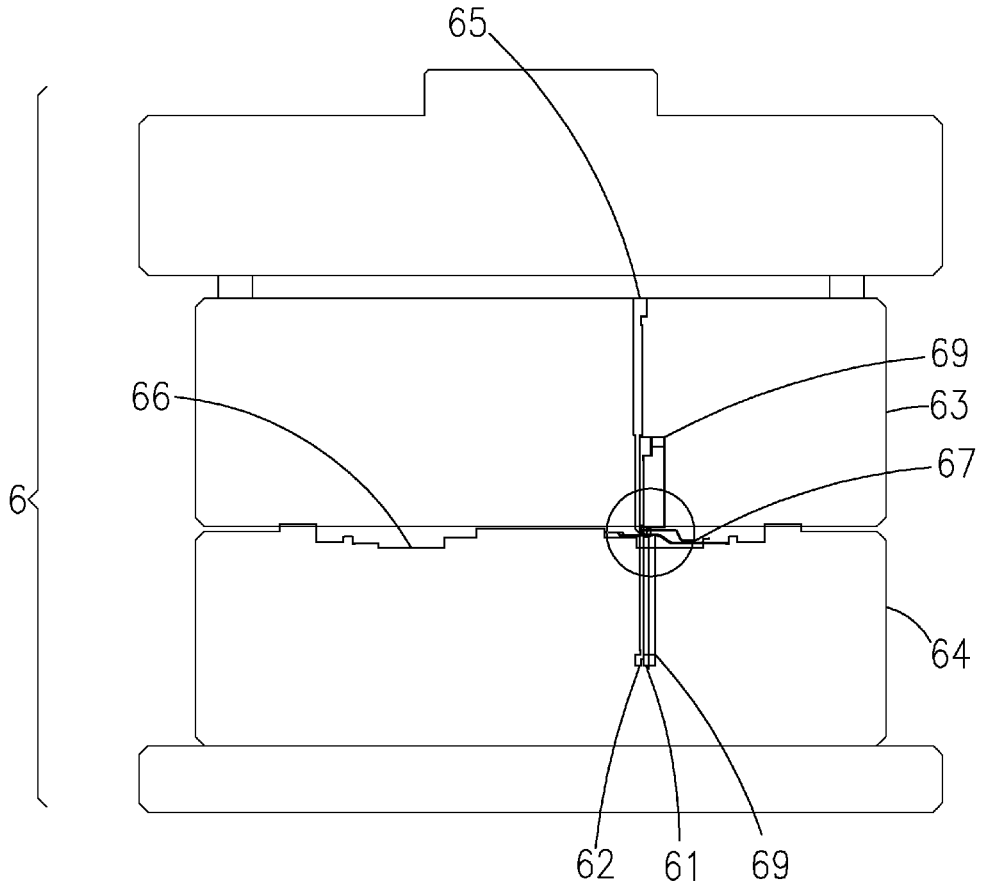
FIG. 7.A is a side view of the die used to manufacture the electrical connector in accordance with an embodiment of the invention, specified the step (c) thereof.
Figure 7B:
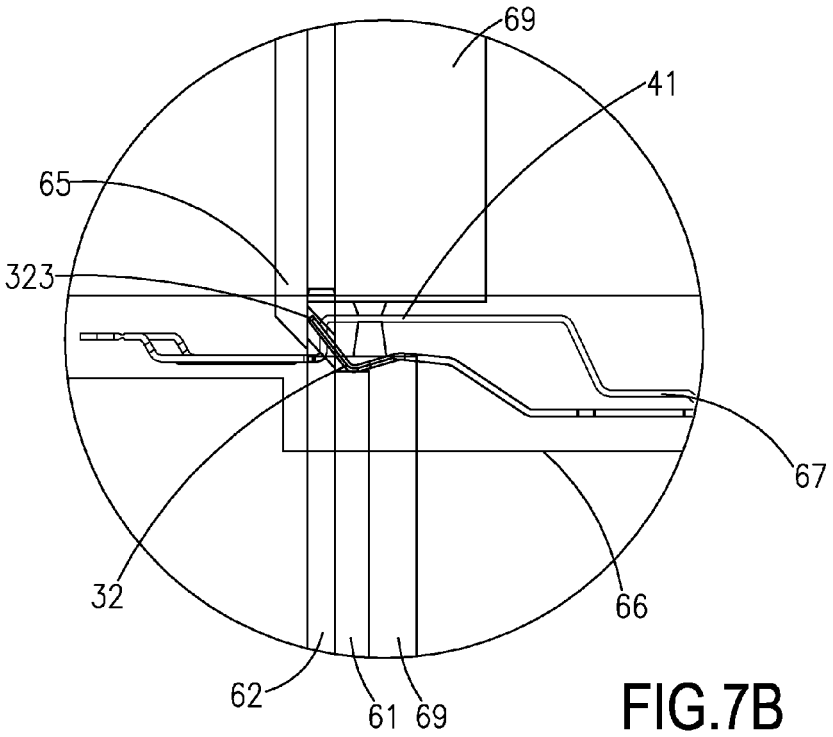
Figure 8B:
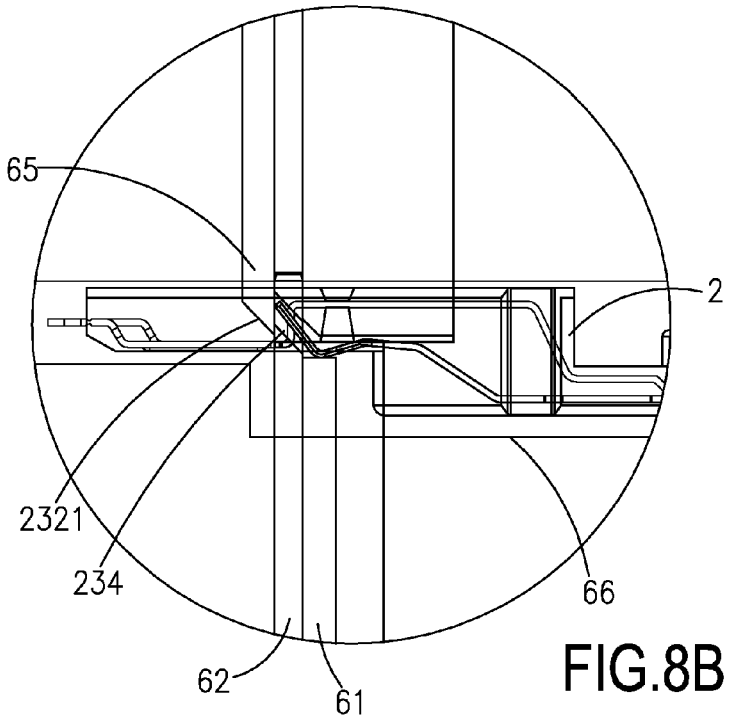
FIG. 8.A is a side view of the die used to manufacture the electrical connector in accordance with an embodiment of the invention, specified the step (d) of method thereof.
Figure 8A:
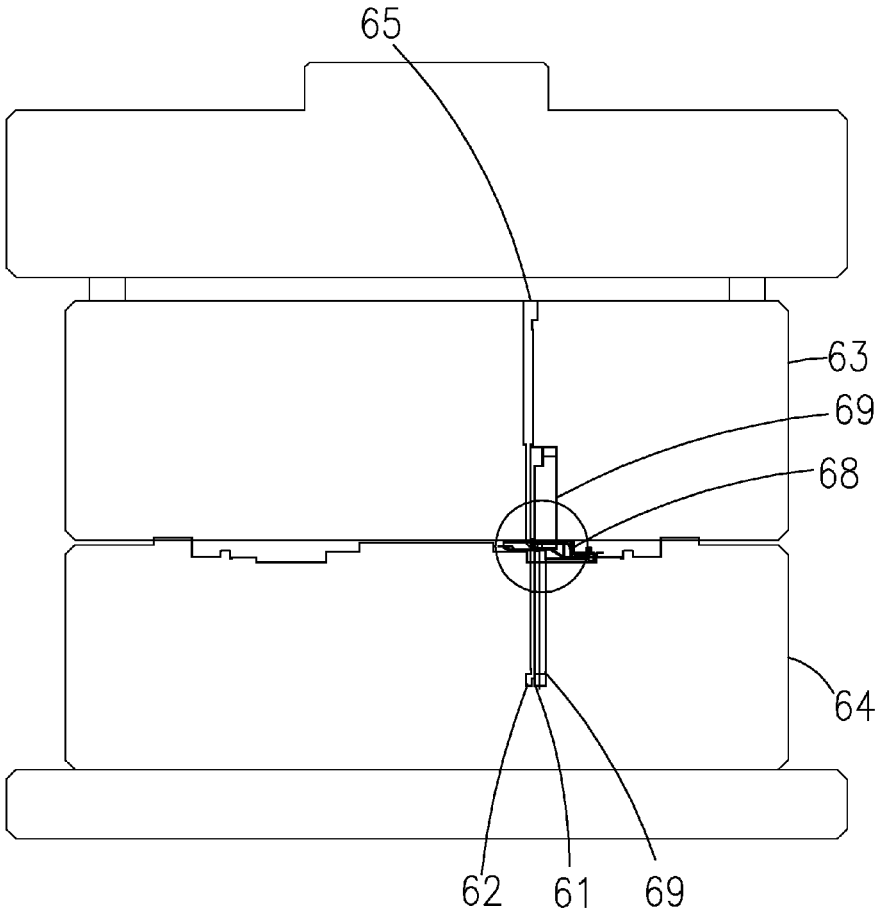
Figure 9:
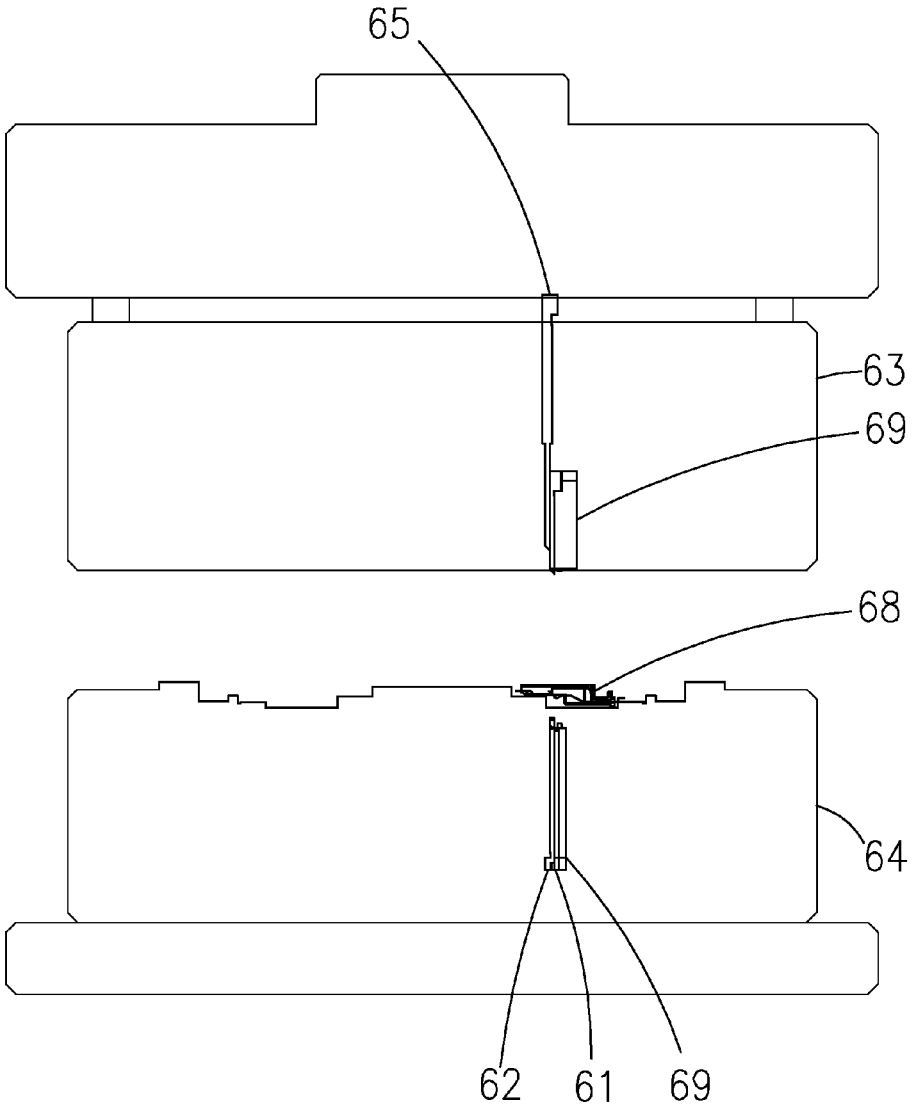
FIG. 9 is a side view of the die used to manufacture the electrical connector in accordance with an embodiment of the invention, specified the step (e) of method thereof.
Figure 10:
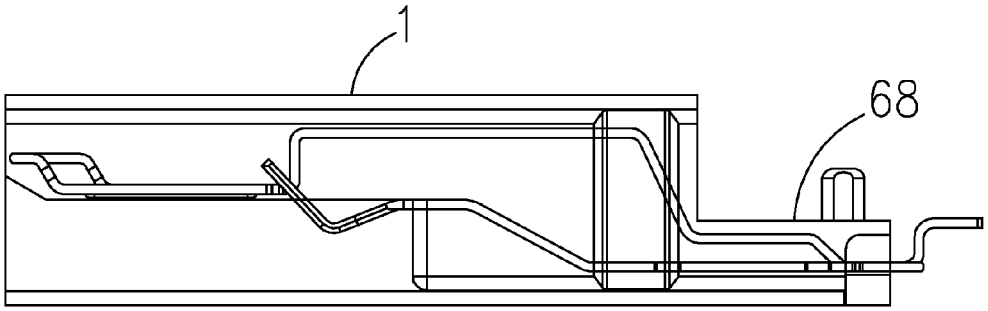
FIG. 10 is a side view of the electrical connector in accordance with an embodiment of the invention, specified the step (f) of method thereof.

For saving the time to produce the electrical connector in accordance with the present invention, and avoiding the undesired increase of the process cost, a manufacture method was employed, which mainly refers to adopt an insert-molding process attaching the terminals 5 with the insulative housing 2, such method comprising the steps of:

(a) providing a plurality of first terminals 3 and a plurality of second terminals 4, and leaving the rest, by stamping one single metal material, which a contact end 32, a rear portion 31 and a body portion 33 configures the first terminals 3, and which a body portion 41 configures the second terminals 4 and extends one end horizontally, wherein the plurality of second terminals 4 crosses with the plurality of first terminals 3 in a transverse direction;

(b) configuring a elastic curve-shape of the contact end 32, and a neck 321, a taper 322 and an engagement 323 in sequence in the section between the contact end 32 and the body portion 33, and configuring both of the terminals 5 being toward the same direction with an up and down arrangement, so as an unfinished metal part 67 be provided;

(c) placing (see FIG. 7 A, B) the unfinished metal part 67 on a hole 66 of a plastic-injecting die 6 reversely, wherein a fender tool 62 and a resisting tool 61 ascend from the bottom, deviating the engagement 323; and a shaping tool 65 descends from the top to keep near to the fender tool 62;

(d) ejecting the plastic (see FIG. 8 A, B) to form the insulative housing 2 which includes a tongue 22 extended along a back-to-front (transverse) direction and a base portion 21 located behind the tongue 22, and which configures a hollow chamber 23 in the center of its body, hereunder the area between the tongue 22 and the base portion 21, wherein the chamber 23 is equally divided into several independent slots 232 by a plurality of ribs 231, wherein a plurality of first terminals 3 is configured on the insulative housing 2 and passes through the slots 232, the rear portion 31 is held by the base portion 21 of the insulative housing 2, the contact end 32 and the body portion 33 are exposed out of the base portion 21, and locate in the slot 232, a preserved space 324 is formed by the leant neck 321 and engagement 323 and under the taper 322, the engagement 323 extends further into the bottom 234 of slots 232, wherein a plurality of second terminals 4 is configured on the insulative housing 2, a body portion 41 is held by the base portion 21 and ribs 231 of the insulative housing 2, one end of second terminal extends out of the base portion 21, the other end passes through the rib 231 and extends to be disposed above of the tongue 22, and which configures ramping portions 2321 in the bottom 234 of slots 232 that ascends the ramping portion 2321 to the base portion 21, located between the shaping tool 65 and the fender tool 62;

(e) replacing (see FIG. 9) tools, descending a fender tool 62 and a resisting tool 61 from the bottom, ascending a shaping tool 65 from the top, and returning the engagement 323 and contacting with the ramping portions 2321 once again, so as a semi-product 68 be provided;

(f) assembling (see FIG. 10) the semi-product 68 with a shell 1, so the electrical connector is finished thereof.

The step (b) further comprises: the taper 322 of the contact end 32 is generally in a curve-shape; the neck 321 is configured from the body portion 33 and extends upwardly to the taper 322.

The step (a) further comprises: the body portion 33 is configuring with a flat 331 and an extension 332. The flat 331 connects the neck 321 in one end and connects to the extension 332 in the other end. And, the extension 332 connects to the rear portion 31. The first terminals 3 configure apertures 3231 on the two side terminal onto the engagement 323 thereof.

The step (c)-(e) further comprises: a clamping tool 69 retains the body portion 41 of the second terminal 4.

The step (c) further comprises: the shaping tool 65 is installed from a top die 63; and the fender tool 62 and the resisting tool 61 are installed from a bottom die 64. The unfinished metal part 67 is placing reversely in the hole 66 formed on the surface of the bottom die 64.

The base portion 21 configures a plurality of posts 211 in bottom for being quick mounting on a circuit board.

The aperture 3231 of first terminal 3 provides the engagement 323 an escape with the second terminal 4, avoiding intervenes of the terminals 5 for sake of the mini-pitches.

As shown in FIG. 3, the shell 1 includes gaps 11 for assembling with the insulatvie housing 2, and a pair of soldering leg 12 for mounting on the circuit board.

While the invention has been described in terms of various specific embodiments, those skilled in the art will recognize that the invention can be practiced with modification within the spirit and scope of the claims.

What is claimed is:

1. A method for manufacturing an electrical connector comprises the steps of:

(a) providing a plurality of first terminals and a plurality of second terminals and leaving the rest, by stamping one single metal material, which a contact end, a rear portion and a body portion configure the first terminals, and which a body portion configures the second terminals and extends one end horizontally, wherein said plurality of second terminals crosses with said plurality of first terminals in a transverse direction;

(b) configuring an elastic curve-shape of the contact end, and a neck, a taper and an engagement in sequence in the section between said contact end and said body portion, and configuring both of the terminals being toward the same direction with an up and down arrangement, so as an unfinished metal part be provided;

(c) placing the unfinished metal part on a hole of a plastic-injecting die reversely, wherein a fender tool and a resisting tool ascend from the bottom, deviating said engagement; and a shaping tool descends from the top to keep near to said fender tool;

(d) ejecting the plastic to form said insulative housing which includes a tongue extended along a back-to-front direction and a base portion located behind said tongue, and which configures a hollow chamber in the center of its body, hereunder the area between said tongue and said base portion, wherein the chamber is equally divided into several independent slots by a plurality of ribs, wherein a plurality of first terminals is configured on the insulative housing and passes through the slots, said rear portion is held by the base portion of the insulative housing, said contact end and said body portion are exposed out of the base portion, and locate in the slot, a preserved space is formed by the leant neck and said engagement and under said taper, said engagement extends further into the bottom of slots, wherein a plurality of second terminals is configured on the insulative housing, said body portion is held by the base portion and ribs of the insulative housing, one end of second terminal extends out of the base portion, the other end passes through the rib and extends to be disposed above of the tongue, and which configures said ramping portions in the bottom of slots that ascends the ramping portion to the base portion, located between the shaping tool and the fender tool;

(e) replacing tools, descending said fender tool and said resisting tool from the bottom, ascending said shaping tool from the top, and returning the engagement and contacting with the ramping portions once again, so as a semi-product be provided;

(f) assembling the semi-product with a shell, so the electrical connector is finished thereof.

2. The method for manufacturing an electrical connector as described in claim 1, wherein the step (b), the taper of said contact end is generally in a curve-shape; said neck is configured from said body portion and extends upwardly t said o said taper.

3. The method for manufacturing an electrical connector as described in claim 1, wherein the step (a), said body portion is configuring with a flat and an extension, said flat connects the neck in one end and connects to said extension in the other end.

4. The method for manufacturing an electrical connector as described in claim 1, wherein the step (a), said first terminals configure apertures on the two side terminal onto said engagement.

5. The method for manufacturing an electrical connector as described in claim 1, wherein the step (c)-(e) further comprising: a clamping tool retains said body portion of the second terminal.

6. The method for manufacturing an electrical connector as described in claim 1, wherein the step (c), said shaping tool is installed from a top die; and said fender tool and said resisting tool are installed from a bottom die, the unfinished metal part is placing reversely in the hole which is formed on the surface of said bottom die.

7. An electrical connector, comprising: an insulative housing, a plurality of first terminals, a plurality of second terminals and a shell, the insulative housing is engaging with the shell and further includes a tongue extended along a back-to-front direction and a base portion located behind the tongue, the insulative housing configures a hollow chamber in the center of its body, hereunder the area between the tongue and the base portion, the chamber is equally divided into several independent slots by a plurality of ribs, which configures ramping portions in the bottom of slots that ascends the ramping portion to the base portion; and a plurality of first terminals is configured on the insulative housing and passes through the slots, wherein each first terminal has an elastic curve-shape contact end, a rear portion and a body portion connecting two, the rear portion is held by the base portion of the insulative housing; the contact end and the body portion are exposed out of the base portion, and locate in the slot, in the section between the contact end and the body portion, a neck, a taper and an engagement are configured in sequence, a preserved space is formed by the leant neck and engagement and under the taper, the engagement extends further into the bottom of slots and remains contacting with the ramping portions; and A plurality of second terminals is configured on the insulative housing and crosses with the plurality of first terminals in a transverse direction, both of the terminals are toward the same direction with an up and down arrangement, a body portion is held by the base portion and ribs of the insulative housing, One end of second terminal extends out of the base portion; the other end passes through the rib and extends to be disposed above of the tongue.

8. The electrical connector as described in claim 7, wherein the taper of the contact end is generally in a curve-shape; said neck is configured from said body portion and extends upwardly to said taper, the preserved space is formed by the leant neck and said engagement and under said taper.

9. The electrical connector as described in claim 7, wherein said body portion is configuring with a flat and an extension, said flat connects said neck in one end and connects to said extension in the other end, said extension connects to said rear portion.

10. The electrical connector as described in claim 7, wherein said first terminals configure apertures on the two side terminal onto said engagement.

* * * * *